US005966911A

United States Patent [19]

Gray et al.

[11] Patent Number: 5,966,911

[45] Date of Patent: Oct. 19, 1999

[54] APPARATUS FOR CONTROLLING HORSES

[76] Inventors: Arthur A. Gray, 19 Naples Dr., West Seneca, N.Y. 14224; Robert Siegelman, 23 Jessica Pl., Roslyn Heights, N.Y. 11577

[21] Appl. No.: 09/119,150

[22] Filed: Jul. 20, 1998

[51] Int. Cl.[6] ..... B68B 1/04

[52] U.S. Cl. ..... 54/36; 54/6.1

[58] Field of Search ..... 54/6.1, 6.2, 16, 54/36

[56] References Cited

U.S. PATENT DOCUMENTS 138,872 5/1873 Elder et al. ..... 54/6.1
153,006 7/1874 Mathews ..... 54/6.1
369,490 9/1887 Williams et al. ..... 54/6.1
532,864 1/1895 Brittain ..... 54/36 X

*Primary Examiner*—Robert P. Swiatek
*Attorney, Agent, or Firm*—Howard J. Greenwald

[57] ABSTRACT

A device for controlling a horse with a line which contains a first layer of material joined to a second layer of material, several filaments located between the first and second layers of material and extending through an opening in one of such layers of material, a locking device connected to such filaments for removably connecting the line to a horse's bit, a first crimping sleeve disposed around such filaments and above the layers of material, and a strap with fastening elements for connecting the line to a horse's bit.

19 Claims, 5 Drawing Sheets

APPARATUS FOR CONTROLLING HORSES

FIELD OF THE INVENTION

A rein for controlling horses which has improved strength characteristics.

BACKGROUND OF THE INVENTION

When riding a horse, lines are essential for controlling the horse; these lines are referred to as lines in harness racing but are often referred to as "reins" in other applications; and, in the remainder of this specification, reference will only be made to "lines" for simplicity of representation.

These lines are well known to those skilled in the art. By way of illustration and not limitation, some typical reins are disclosed in U.S. Pat. Nos. 5,442,900, 5,148,656 (training reins), 5,094,062 (flex rein), 3,604,183, and the like. The disclosure of each of these United States patents is hereby incorporated by reference into this specification.

Typically the lines are buckled to rings at each end of a bit in the horse's mouth; the lines or reins work together to establish a primary link and means of communication between the horse and the driver or rider. By using the lines to exert or release pressure on the bit, the driver relays commands to the horse. Depending upon the individual horse's temperment and what conditions exist, various amounts of pressure are applied to the lines. In racing competitions, a tremendous amount of pressure is placed on the lines.

If a line breaks away from one side of the bit, the driver loses all control of the horse; he is helpless and subject to being involved in a serious accident. The resulting dangerous situation endangers not only the horse and driver but also any other horses and drivers near the team with the broken line. This type of incident has caused serious injury and death to both man and/or horse. The worst case scenario, which happens all too often, is when a line breaks in a race or during a training mile. The break in the line occurs where the line is buckled to the bit either as a result of stress or human error.

It is an object of this invention to provide an apparatus for controlling a horse which is substantially stronger and less likely to fail than prior art devices.

SUMMARY OF THE INVENTION

In accordance with this invention, there is provided an apparatus for controlling a horse which comprises a line, a first buckle connected to the line at a point near the distal end of the line, and a second buckle formed by looping the distal end of the line through the horse's bit.

BRIEF DESCRIPTION OF THE DRAWINGS

The invention will be described by reference to the following specification and to the drawings, in which like numerals refer to like elements, and in which.

DESCRIPTION OF THE PREFERRED EMBODIMENTS

Figure 1:
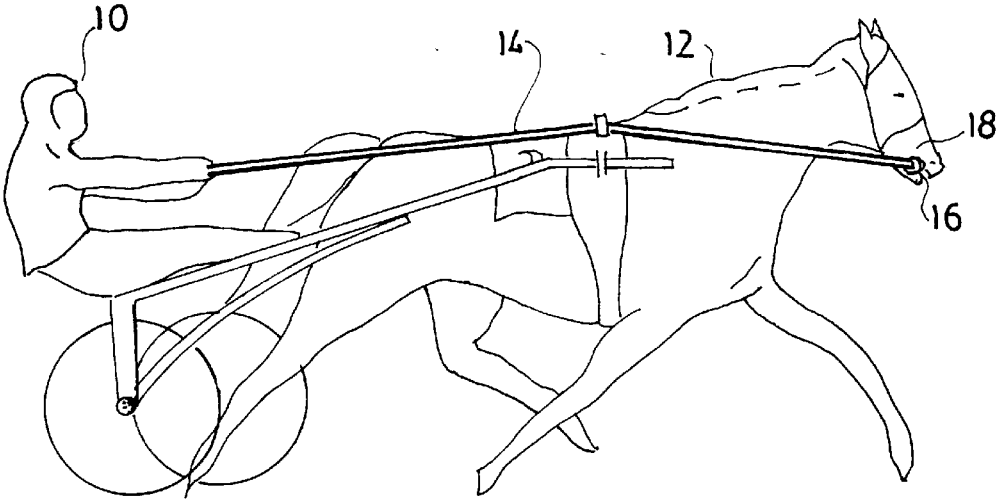
FIG. 1 is a side view of a driver controlling a harness horse by means of a line.

FIG. 1 illustrates a typical use for the line of this invention. Referring to FIG. 1, it will be seen that a driver 10 is controlling a standardbred harness horse 12 by means of a line 14 connected to a bit 16, which bit 16 is attached to bridle 18. These components and devices are well known to those skilled in the art and are described, e.g., in U.S. Pat. Nos. 5,517,949, 5,442,900, 5,435,318 (bridle), 5,357,735 (adjustable horse bit), 5,225,499 (race horse harness attachment), 5,148,656 (training reins), 5,094,062 (flex reins), 5,062,255 (bridle bit), and the like. The disclosure of each of these United States patents is hereby incorporated by reference into this specification.

Figure 2:
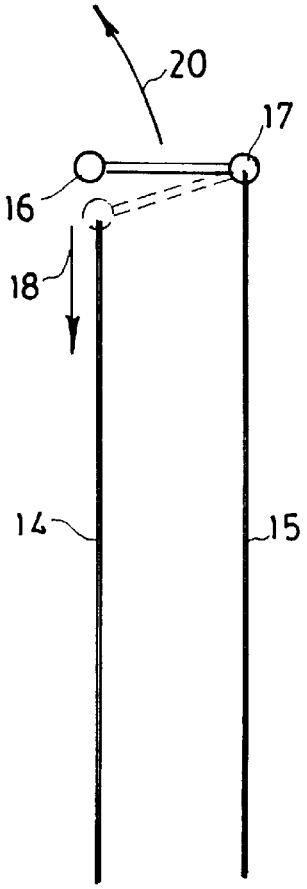
FIGS. 2 and 3 schematically illustrate how a driver can control a horse by pulling on one line or the other.
Figure 3:
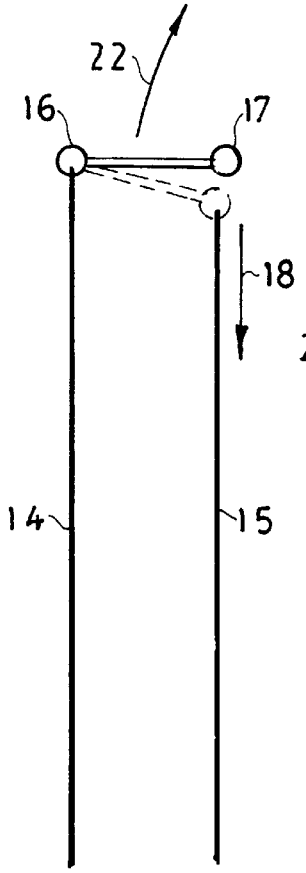

As is well known to those skilled in the art, two lines are typically used to control the horse 12. FIG. 2 schematically illustrates that when line 14 is used to pull bit 16 in the direction of arrow 18, the horse (not shown) will tend to move in the direction of arrow 20. FIG. 3 illustrates that when line 15 is used to pull bit 17 in the direction of arrow 18, the horse (not shown)/will tend to move in the direction of arrow 22. When both lines 14 and 15 are pulled with substantially equal force in the direction of arrow 18, the horse (not shown) will generally slow down or stop.

Figure 4:
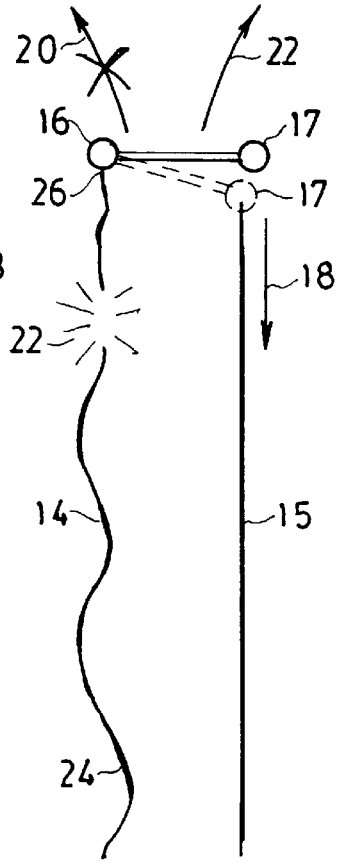
FIG. 4 schematically illustrates the loss of control over the horse which occurs when one of the lines breaks.

FIG. 4 illustrates what happens when a break 22 occurs in either line 14 or line 15. For the sake of simplicity or representation, break 22 is shown as occurring intermediate the proximal end 24 and the distal end 26 of line 14. However, most frequently, such breaks 22 occur at the distal end 26 of line 14, right near the bit 16.

Referring to FIG. 4, when break 22 occurs, the driver 10 is no longer able to either slow down or stop the horse, or to have it turn in the direction of arrow 20. His sole control, if he continues to pull on the line 15, is to have the horse turn in the direction of arrow 22. When this occurs, an extremely dangerous situation results. Several times when this has occurred, the applicant has seen the driver stand up in the sulky and jump onto the horse's back in order to regain control and prevent any injury. If a driver misses in this situation, he is in big trouble.

Figure 5:
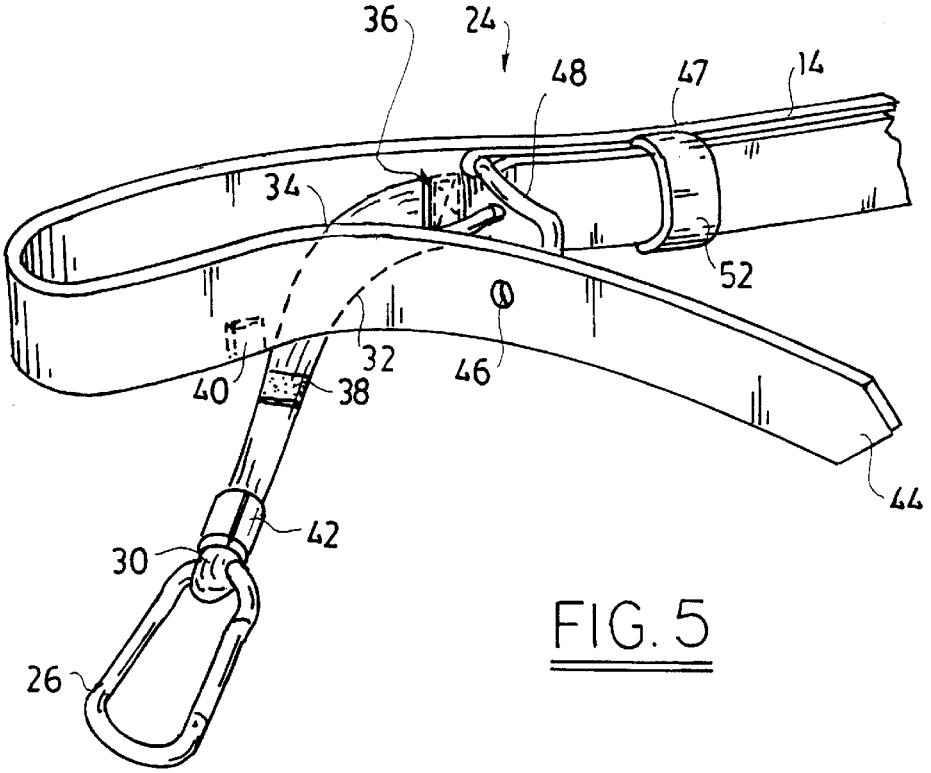
FIG. 5 is a perspective view of one preferred line of the invention.

FIG. 5 is a schematic view of a distal portion of a preferred line of this invention which is substantially less likely to break in use than prior art horse lines.

Referring to FIG. 5, it will be seen that, for sake of simplicity of representation, the proximal portion and the intermediate portion of the line 14 are not shown. The remainder of the horse line 14 may be conventional. As is well known to those skilled in the art, conventional horse lines are made out of leather, nylon, and/or hard rubber and generally range in length from about 92 to about 104 inches.

Figure 6:
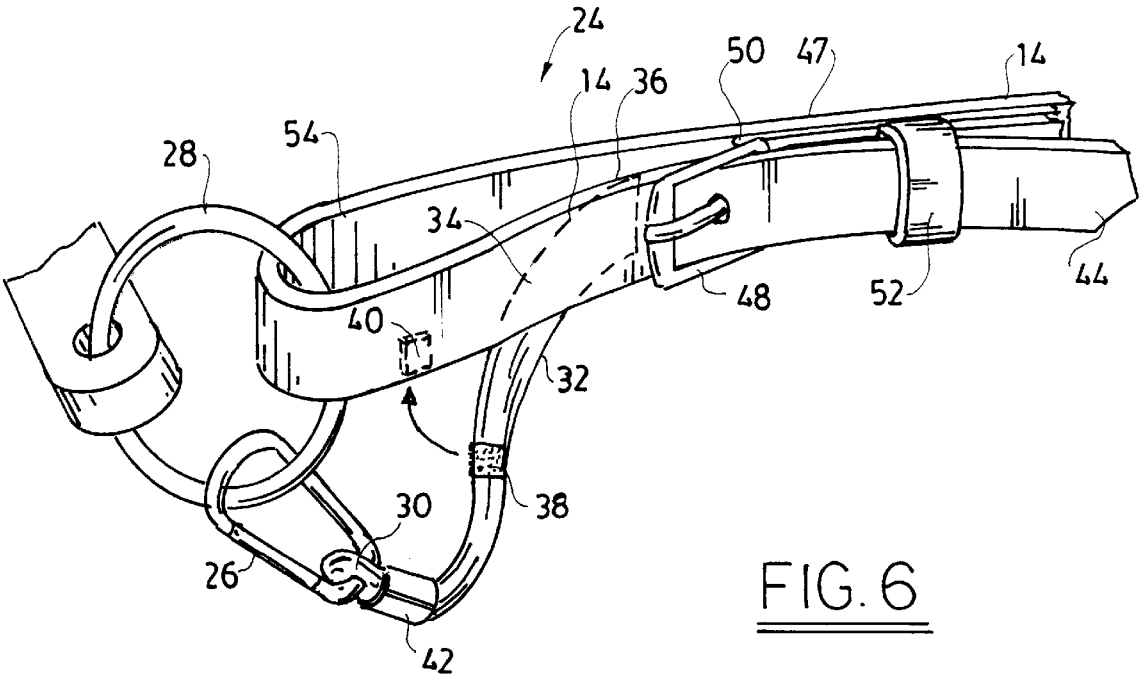
FIG. 6 is a perspective view of the line of FIG. 5, showing it connected to a horse's bit.

Referring again to FIG. 5, and to the preferred embodiment depicted therein, it will be seen that the distal portion 24 of the line 14 is comprised of a snap hook 26 which can readily be connected and disconnected from bit 28 (see FIG. 6). These snap hooks 26 are well known to those skilled in the art and are described, e.g., in U.S. Pat. Nos. 5,762,282 (locking snap hook or carabiner), 5,738,033 (carabiner like hooks, safety hooks, and connector hardware), 5,727,646 (hook, bracket, carabinber, and other types of hardware that can be readily connected or disconnected), 5,692,306 (carabiner hook), 5,687,535, (hook or carabiner), 5,634,499 (hook or carabiner), 5,608,961 (carabiner hook), 5,570,512 (carabiner hook), 5,560,441 (carabiner or quick link), 5,553,685, 5,526,896, 5,463,798 (self locking carabiner), 5,370,202 (snap lock or carabiner), and the like. The entire disclosure of each of these United States patents is hereby incorporated by reference into this specification.

In one embodiment, the preferred snap hook 26 is a carabiner. As is known to those skilled in the art, a carabiner is a C-shaped, load bearing hook member with a closing member at the end. See, e.g., the 1997 "Black Diamond Equipment Spring" catalog published by Black Diamond Equipment, Ltd of 2084 East 3900 South Street,Salt Lake City, Utah. At page 5, 8, and 11 of this catalog, screw lock carabiners are illustrated. At pages 7 and 12 of this catalog, snap lock carabiners are illustrated.

In one embodiment, the snap hook 26 will withstand a force of at least about 700 pounds and, more preferably, at least about 900 pounds; thus, it has a tensile strength of at least about 700 pounds. One such hook is sold as the "Wichard stainless steel carabiner hook" which is sold by the Inoy Company as Standard part number 2313; it has a tensile strength of 990 pounds.

Referring again to FIGS. 5 and 6, and to the preferred embodiment depicted therein, it will be seen that snap hook 26 is connected to a line 30 which, in turn, is anchored within line 14. In the embodiment depicted in FIGS. 5 and 6, a first portion 32 of line 30 is wound around snap hook 26, and a second portion 34 of the line 30 is returned to the original anchoring point 36 within line 14. FIGS. 10, 11, 12, and 13 illustrate one preferred means of anchoring line 30 within line 14.

In one preferred embodiment, the line 30 has a tensile strength of at least about 200 pounds and, more preferably, at least about 400 pounds. In this embodiment, it is preferred that line 30 be fishing line.

Fishing line is well known to those skilled in the art and is described, e.g., in U.S. Pat. Nos. 5,524,385, 5,507,112, 5,375,366, 5,369,906, 5,369,905, 4,779,372, 4,514,927, 3,453,769, and the like. The disclosure of each of these United States patents is hereby incorporated by reference into this specification.

In one preferred embodiment, the fishing line used is "Black Marlin" leader line. In the preferred embodiment depicted in FIG. 6, "VELCRO" hook fastening material 38 is wrapped around line 30 and, when hook 26 is connected to bit 28, is placed contiguous with "VELCRO" loop fastening material 40, thereby holding line 30 in place.

Referring again to FIGS. 5 and 6, and to the preferred embodiment depicted therein, it will be seen that crimping sleeve 42 secures first portion 32 and second portion 34 of line 30 and holds them tightly together. One may use any conventional crimping sleeve as crimping sleeve 32. Thus, by way of illustration and not limitation, one may use one or more of the crimping sleeves disclosed in U.S. Pat. Nos. 5,586,912, 5,766,234, 5,766,173, 5,761,949, 5,758,406, 5,752,361, 5,751,535, and the like. The disclosure of each of these United States patents is hereby incorporated by reference into this specification.

Referring again to FIGS. 5 and 6, and to the preferred embodiment depicted therein, it will be seen that line 24 has a conventional loop forming means, such as a strap 47, which is comprised of the end 44 of line 14, an orifice 46 preferably located within about 5 inches of end 44, a buckle 48 connected to the inner surface 50 of line 14, and a sleeve 52. In order to form loop 54 (see FIG. 6), the end 44 of line 14 is passed through bit 28, and thence through buckle 48, and thence through sleeve 52.

The preferred loop forming means is a strap. As is known to those skilled in the art, a strap is a long, narrow strip of leather or other material equipped with a buckle and/or other fastening means for binding or securing objects. Such strap retaining devices are well known and are described, e.g., in U.S. Pat. Nos. 5,621,953, 5,620,231, 5,615,923, 5,611,644, 5,607,334, 5,606,779, 5,600,875, 5,600,854, 5,598,588, 5,593,373, 5,586,705, and the like. The disclosure of each of these United States patents is hereby incorporated by reference into this specification.

Figure 7:
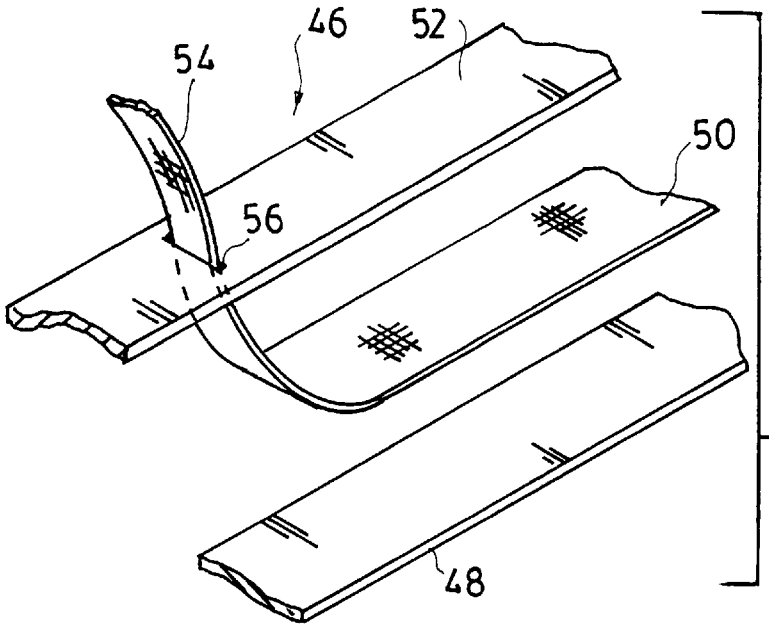
FIG. 7 is an exploded view of a portion of one preferred line of the invention.
Figure 9:
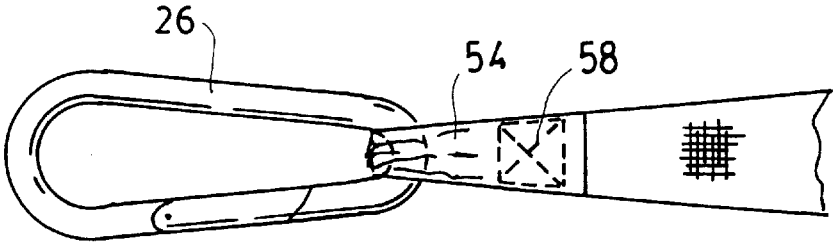
FIG. 9 is a side view illustrating how the line of FIGS. 7 and 8 may be connected to a buckle.

FIG. 7 is an exploded partial view of a portion of line 46 which, in the preferred embodiment depicted, is a laminated structure comprised of layer 48 (which may be made out of leather or nylon), intermediate nylon layer 50, and top layer 52 (which also may be made from leather or nylon. A portion 54 of layer 50 extends through a slot 56 in layer 52. As is illustrated in FIG. 9, portion 54 extends through snap lock 26 and, in the embodiment depicted in FIG. 9, is folded back onto itself and stitched together by nylon stitches 58.

Figure 8:
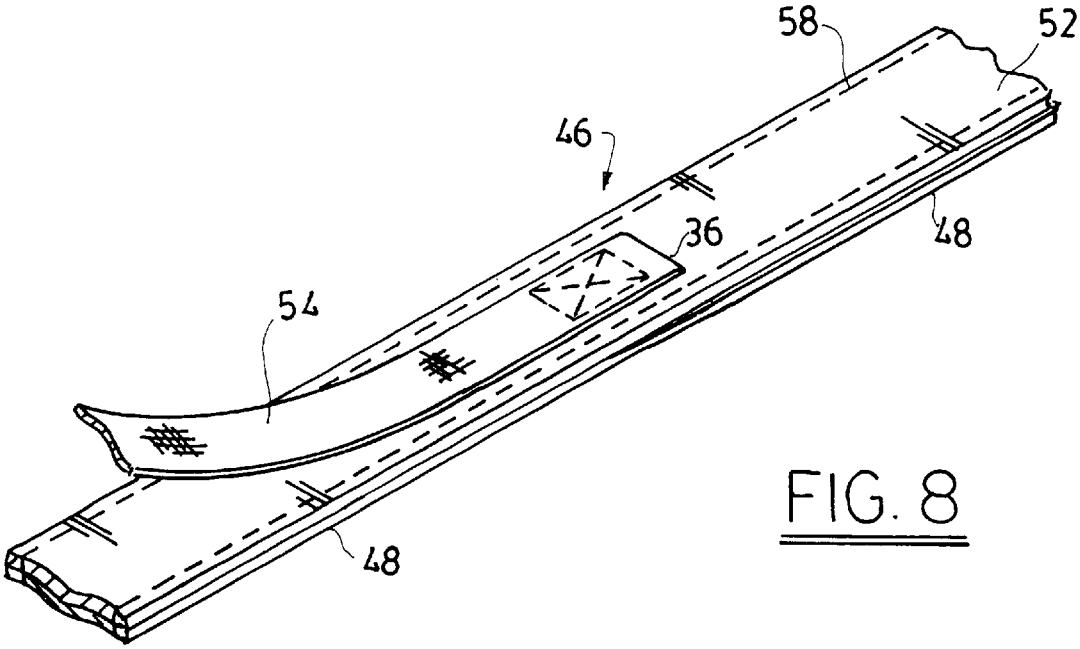
FIG. 8 is another exploded view of a portion of one preferred line of the invention.

As is illustrated in FIG. 8, it is preferred to join layers 48, 50, and 52 to each other by stitches such as, e.g., nylon stitches 58.

Figure 10:
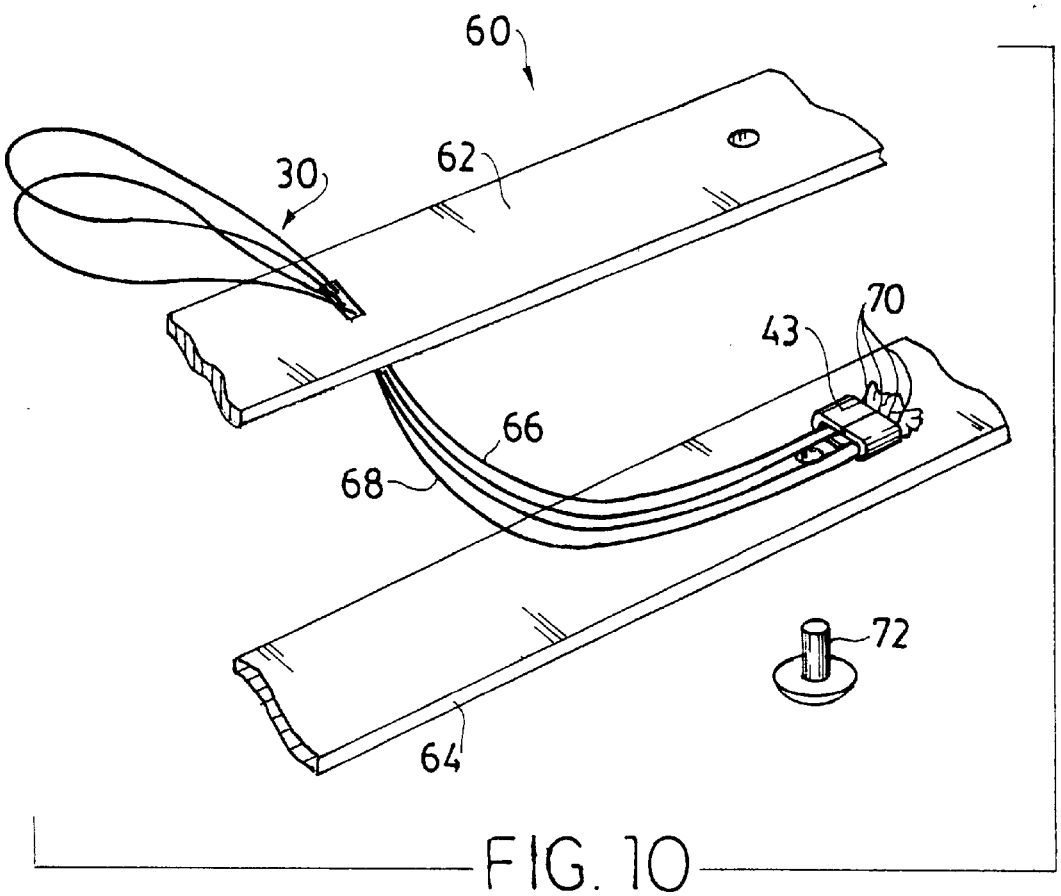
FIG. 10 is an exploded view of a portion of another preferred line of the invention.
Figure 11:
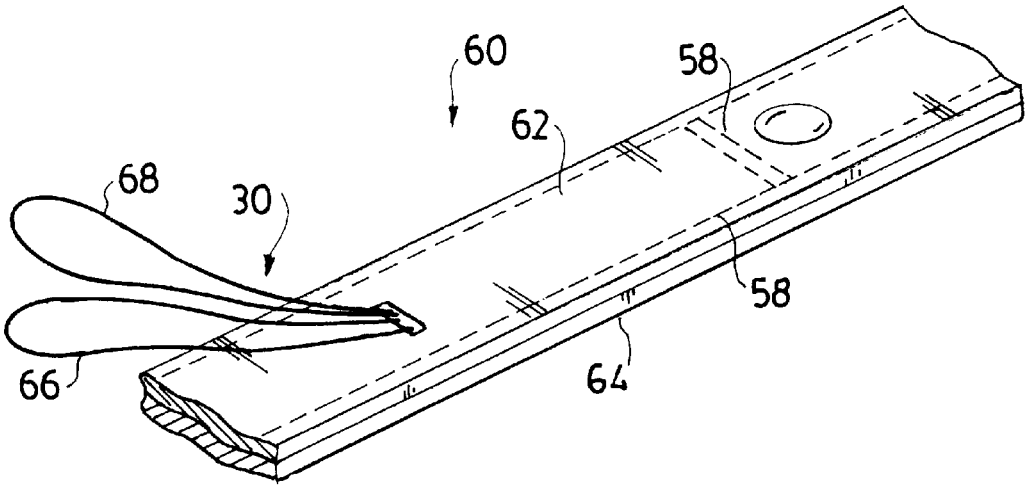
FIG. 11 is a perspective view of a portion of the line of FIG. 10.
Figure 12:
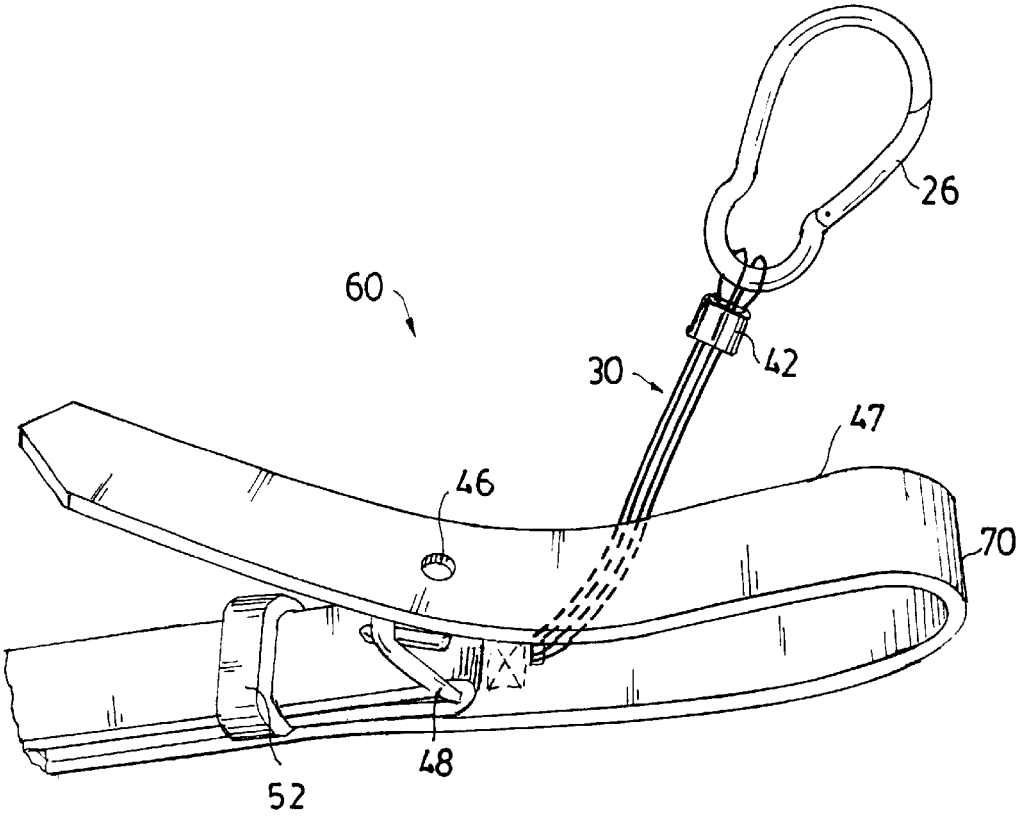
FIG. 12 is a perspective view illustrating how a portion of the buckles of the line of FIGS. 10 and 11 is formed.

FIGS. 10, 11, and 12 illustrate one preferred means for attaching line 30 to buckle 46. It will be seen that, in the preferred embodiment depicted, line 60 is comprised of a top layer of material 62 and a bottom layer of material 64. One or both of layers 62 and 64 may be leather, one or both of layers 62 and 64 may be nylon, one of layers 62 may be leather and the other may be nylon, etc. As is illustrated in FIG. 11, layers 62 and 64 are preferably joined to each by conventional means such as, e.g., nylon stitches 58. Additionally, one may secure layers 62 and 64 to each other by adhesive means, such as epoxy adhesive.

Figure 13:
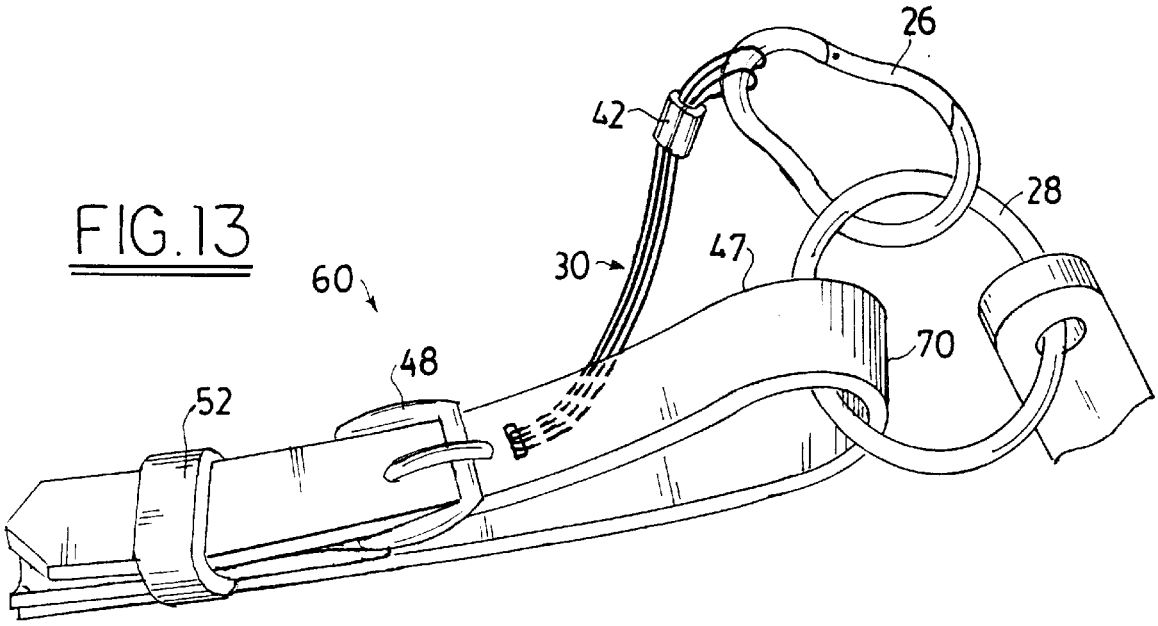
FIG. 13 is a perspective view illustrating how a portion of the line of FIGS. 10, 11, and 12 is connected to a horse's bit.

Disposed between layers 56 and 58 are at least two double lines 66 and 68 which, cumulatively, form line 30 (see FIGS. 12 and 13). Without wishing to be bound to any particular theory, applicants believe that the use of a multiplicity of lines, such as fishing lines, imparts greater strength to the structure. Thus one may use two such lines, three such lines, etc.

Referring again to FIG. 10, and in the preferred embodiment depicted, the two double lines 66 and 68, which form four individual lines, are crimped by crimping sleeve 43, which is attached to layer 64. It is preferred to crush crimping sleeve 42 to insure that it retains double lines 66 and 68. It is preferred that crimping sleeve 43 be disposed at least about 12 inches from the opening 56 through which the four individual lines extend.

The four ends 70 of double lines 66 and 68 are heated until their materials melt and then fuse into one mass.

A rivet 72 is disposed within layer 64, within layer 62, and between each of double lines 66 and 68 to further secure such lines between layers 62 and 64.

FIGS. 12 and 13 illustrate how the line 60 may be attached to snap lock 26 which, in turn, may be attached to bit 28. It should be noted that, in the embodiment depicted in FIG. 12, additional stitching 58 is used near the buckle 48 to further secure line 30.

In the preferred embodiment depicted in FIG. 13, when buckle 26 is contiguous with strap 47, then buckle 26 will extend past the end 70 of strap 47 by from about 0.2 to about 0.5 inches. Consequently, if strap 47 ever were to break, the snap lock 26 will become readily engaged.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A device for controlling a horse comprising a line with a proximal end and a distal end, wherein said line comprises:

(a) a first layer of material joined to a second layer of material, (b) a first filament, a second filament, a third filament, and fourth filament disposed between said first layer of material and said second layer of material and connected to said first layer of material and contiguous with both said first layer of material and said second layer of material, wherein said first filament, said second filament, said third filament, and said fourth filament extend through an opening formed in one of said first layer of material and said second layer of material and are connected to a means for removably connecting said line to a horse's bit;

(c) a first crimping sleeve disposed around said first filament, said second filament, said third filament, and said fourth filament, wherein said crimping sleeve is disposed above said second layer of material; and (d) a strap comprised of fastening means.

2. The device as recited in claim 1, wherein said first filament, said second filament, said third filament, and said fourth filament extend through an opening formed in said second layer of material.

3. The device as recited in claim 2, wherein said first layer of material consists essentially of nylon.

4. The device as recited in claim 3, wherein said second layer of material consists essentially of leather.

5. The device as recited in claim 4, wherein said device further comprises a rivet extending through said first layer of material, said second layer of material, and wherein said rivet is disposed between said first filament, said second filament, said third filament, and said fourth filament.

6. The device as recited in claim 5, wherein said first layer of material is stitched together to said second layer of material.

7. The device as recited in claim 6, wherein said first filament, said second filament, said third filament, and said fourth filament consist are fishing line filament.

8. The device as recited in claim 7, wherein said fastening means of said strap comprises a buckle.

9. The device as recited in claim 8, wherein said fastening means of said strap comprises a sleeve.

10. The device as recited in claim 9, wherein said means for removably connecting said line to a horse's bit is a snap lock.

11. The device as recited in claim 10, wherein said snap lock is a carabiner lock.

12. The device as recited in claim 11, wherein said line has a length of from about 92 to about 104 inches.

13. The device as recited in claim 12, wherein said carabiner lock has a tensile strength of at least about 900 pounds.

14. The device as recited in claim 13, wherein, when said carabiner lock is contiguous with said strap, said carabiner lock extends beyond said strap by a distance of from about 0.2 to about 0.5 inches.

15. The device as recited in claim 14, wherein each of said first filament, said second filament, said third filament, and said fourth filament has a tensile strength of at least about 400 pounds.

16. The device as recited in claim 15, wherein each of said first filament, said second filament, said third filament, and said fourth filament are attached to said first layer of material by a second crimping sleeve.

17. The device as recited in claim 16, wherein said second crimping sleeve is crushed.

18. The device as recited in claim 17, wherein each of said first filament, said second filament, said third filament, and said fourth filament extend past said second crimping sleeve and form an integral, fused mass of material.

19. The device as recited in claim 18, wherein said second crimping sleeve is disposed at least about twelve inches from said carabiner lock.

* * * * *